US006115852A

United States Patent [19]

Olivas

[11] Patent Number: 6,115,852

[45] Date of Patent: Sep. 12, 2000

[54] ADJUSTABLE REPLACEMENT RING FOR A TOILET FLANGE AND METHOD

[75] Inventor: Abran Olivas, Las Vegas, Nev.

[73] Assignee: Dora To, Las Vegas, Nev.

[21] Appl. No.: 09/359,852

[22] Filed: Jul. 23, 1999

[51] Int. Cl.[7] ..... E03D 11/00; E03D 11/14

[52] U.S. Cl. ..... 4/252.3; 4/252.1; 4/252.4; 285/56; 285/415

[58] Field of Search ..... 4/252.1–252.6; 285/56–60, 414, 415; 277/608, 609

[56] References Cited

U.S. PATENT DOCUMENTS

| | | | |
|---|---|---|---|
| 773,734 | 11/1904 | Griffiths | 4/252.5 |
| 1,324,316 | 12/1919 | Lewis | 285/45 |
| 2,764,431 | 9/1956 | Wilde | 285/415 |
| 3,004,780 | 10/1961 | Main | 285/415 |
| 3,319,268 | 5/1967 | Blumenkranz | 4/252.4 |
| 3,775,780 | 12/1973 | McEwen | 4/252.4 |
| 5,492,372 | 2/1996 | Dranberg | 285/56 |

*Primary Examiner*—David J. Walczak
*Assistant Examiner*—Tuan Nguyen
*Attorney, Agent, or Firm*—Quirk & Tratos

[57] ABSTRACT

An adjustable replacement toilet ring for securing a toilet in fluid communication with the flange of a sewer pipe is disclosed. The ring includes at least two ring segments which may be adjustably assembled around a sewer pipe and may be secured to a toilet. The ring segments have a flat collar portion and an end portion perpendicular to the flat collar portion. The ring segments are preferably adjustably assembled through holes in the end portions through which a bolt may be disposed. The bolt both holds the segments together but also allows the diameter of the ring to be adjusted.

7 Claims, 4 Drawing Sheets

ADJUSTABLE REPLACEMENT RING FOR A TOILET FLANGE AND METHOD

FIELD OF THE INVENTION

The present invention relates to replacement rings for toilet systems. Specifically, the present invention is an adjustable replacement toilet ring which clamps around a sewer pipe to secure a toilet in communication therewith and method for using the adjustable replacement ring on a toilet flange.

BACKGROUND OF THE INVENTION

As with any plumbing fixture, toilets are subject to corrosion and other wear due to age, ambient moisture, stresses, water leakage, and the like. For example, in a typical toilet system, a ring, secured to the floor, attaches to a toilet and holds the toilet in position over the sewer pipe flange. A gasket is usually provided to maintain the toilet drain in fluid communication with the sewer pipe. However, as alluded to above, the ring often corrodes and weakens. This weakening can be attributed to a variety of factors such as the moisture leaking from the connection between the toilet drain and the sewer pipe, the age of the toilet system, the stresses of securing the toilet to the floor, and the ambient moisture in the air of a typical bathroom which may include a sink, shower, and other water sources. Moreover, it is known in the art that discontinuities in materials such as holes, bends, and the like, increase the local stress and, thus, are most likely to be the site of stress and corrosion induced failure.

When this weakening occurs, the toilet ring must be replaced. In a typical toilet system, the sewer pipe is flared at its end proximate the toilet drain. The ring is disposed in a channel around the circumference of the sewer pipe below the toilet flange and is secured to the floor.

One replacement flange and ring combination in the prior art is a continuous ring. Because these prior art flange and ring combinations were continuous, the channel and flare would have to be cut from the sewer pipe, such as with a jackhammer, and the entire upper end of the sewer pipe replaced along with a new flange and ring. This often resulted in leakage and required a great deal of time and effort.

Another replacement ring in the prior art is disclosed by Dranberg in U.S. Pat. No. 5,492,372. This replacement ring is similar to the original ring with two overlapping joints. These joints allow the replacement ring to be inserted into the existing channel which held the original ring and secured to the floor after the original ring is removed. Thus, this replacement ring eliminates the steps of cutting the flare from the sewer pipe and replacing the upper end of the sewer pipe.

However, the device of Dranberg has three disadvantages. First, as discussed above, toilet rings often corrode and weaken at or near the holes securing the toilet ring to the floor because the local stresses are increased near the holes. Because the device of Dranberg is intended to be secured to the floor through holes, the device does not solve the problem of corrosion around the floor holes.

Second, the device of Dranberg has a fixed diameter. Thus, different diameter rings must be made to accommodate different diameter sewer pipes.

Third, because the device of Dranberg is intended to fit within the existing channel around the sewer pipe, the device may not be used if the channel is itself corroded or otherwise damaged. For example, if the channel is corroded or damaged while removing the original ring, the device of Dranberg cannot be used.

Thus, it can be seen that there is a need in the art for a replacement toilet ring which fits around the existing flared sewer pipe below the flange, does not require holes for securing the ring to the floor, is adjustable to accommodate different diameter sewer pipes, and may be secured to the flared sewer pipe itself rather than the channel around the flare.

SUMMARY OF THE INVENTION

A ring for securing a toilet in fluid communication with an outwardly flared sewer pipe includes a plurality of ring segments. Any number of segments may be provided, however, two substantially semicircular segments are provided in a preferred embodiment.

Each ring segment includes a flat collar portion and at least one end portion extending perpendicular to the collar portion. In one embodiment, one end of each ring segment is flat to form a hinge, as discussed hereinafter, and the other end is perpendicular to the collar portion. In an alternate embodiment, both ends of each ring segment are perpendicular to the collar portion. Each ring segment includes means, such as slots through which bolts may be inserted, for securing the assembled ring to the toilet.

A fastener is is provided to assemble the ring segments to form a substantially circular ring around the sewer pipe flare. In one embodiment, one of the assembling means is a hinge securing the flat ends of the segments to one another.

Means are provided to adjust the diameter of the circular ring. Preferably, the end portions include holes which align when the ring is assembled. In this embodiment, the adjusting means is a bolt is disposed through the holes to allow a user to vary the diameter of the ring. In an embodiment where both end portions of each ring segment extend perpendicular to the collar portion, bolts disposed through holes in the end portions serve to both fasten the ring segments to one another and adjust the diameter of the ring.

To use the replacement toilet ring, the toilet is first disconnected from the existing toilet ring. The toilet is disengaged from the toilet flange at the end of the flared sewer pipe. The existing toilet ring is then disconnected from the floor. The toilet ring is removed from the channel surrounding the flared sewer pipe while leaving the flare intact.

The ring segments are arranged around the sewer pipe below the flare and the replacement toilet ring is assembled. The diameter of the ring is adjusted to clamp securely around the flare of the sewer pipe.

The toilet is positioned over the replacement ring with the toilet drain in fluid communication with the flange at the end of the sewer pipe. The toilet is secured to the ring.

It is an object of the present invention to provide a replacement toilet ring which may be assembled around a flared sewer pipe. It is another object of the present invention to provide a replacement toilet ring which reduces the number of holes in the toilet ring to thereby reduce the locations where corrosion and weakening may occur. Yet another object of the invention is to provide a replacement ring which can accommodate different diameter sewer pipes. A further object of the invention is to provide a replacement ring which can be used to secure a toilet to a sewer pipe without using the channel disposed around the sewer pipe.

DESCRIPTION

Figure 1:
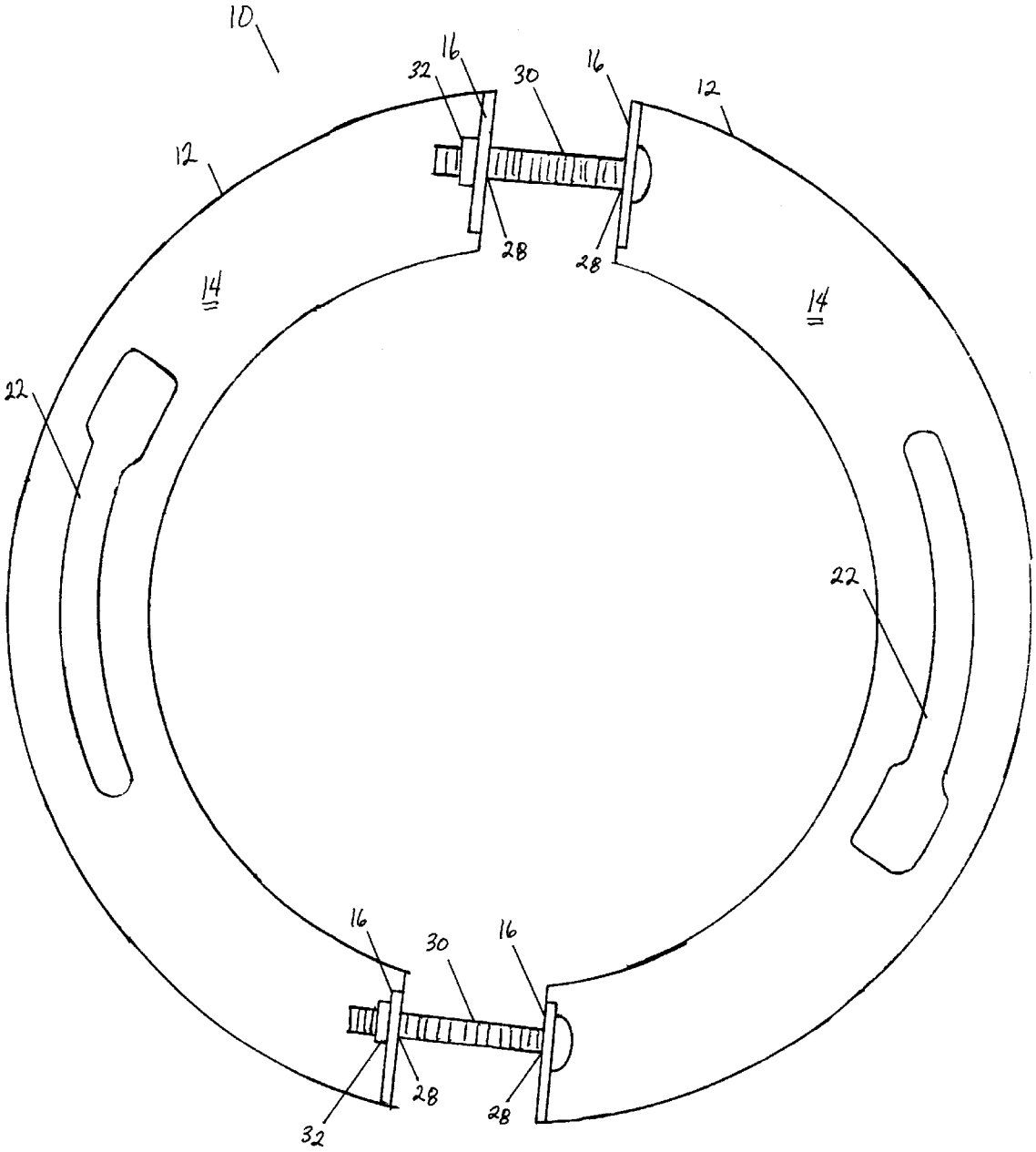
FIG. 1 shows a top view of an embodiment of the ring of the present invention.
Figure 2:
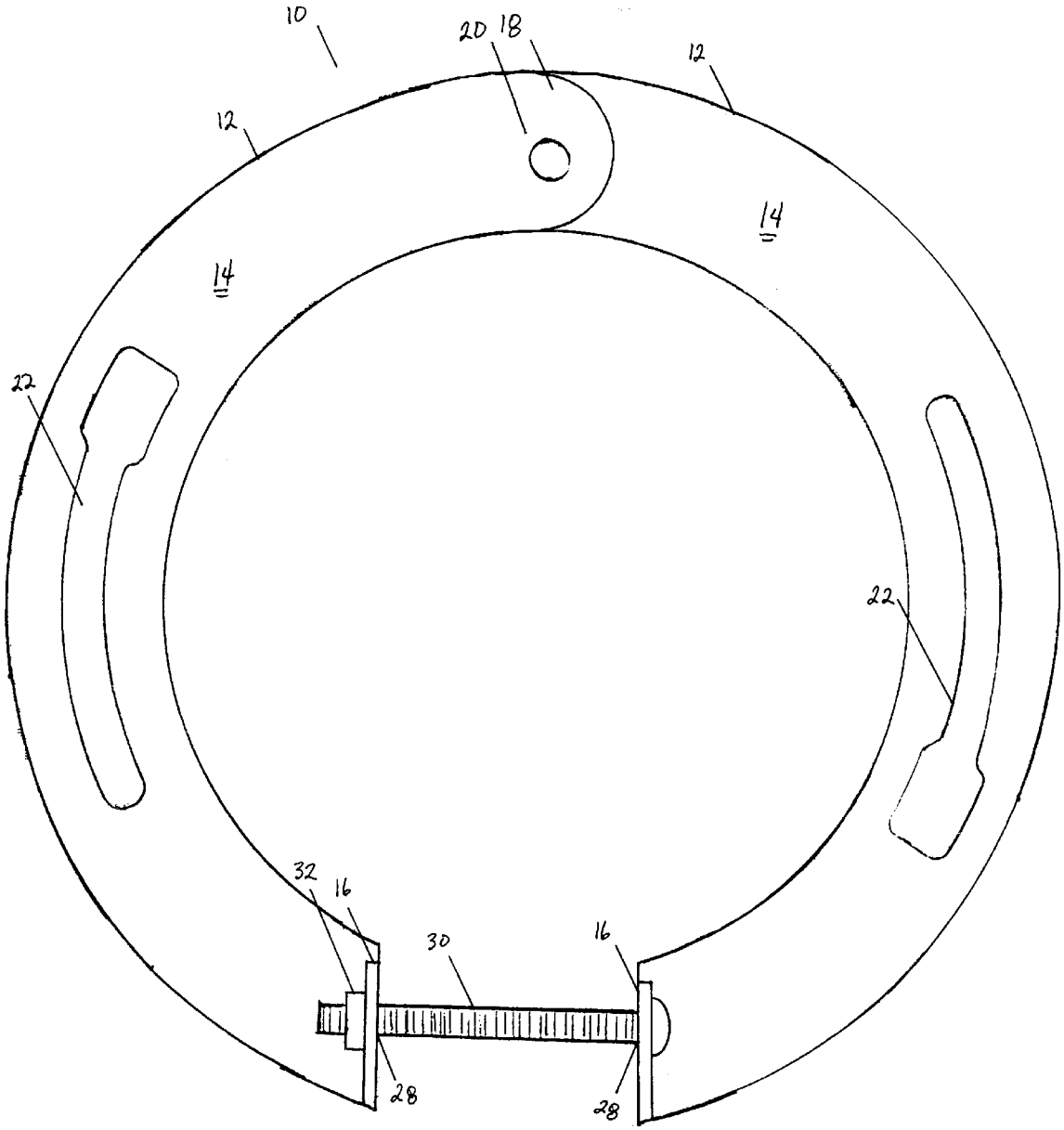
FIG. 2 shows a top view of another embodiment of the ring of the present invention.

Reference is now made to the figures wherein like parts are referred to by like numerals throughout. With reference to FIGS. 1 and 2, the replacement ring 10 of the present invention includes a plurality of ring segments 12. In a preferred embodiment, the ring 10 includes two substantially semicircular ring segments 12. However, it is contemplated that any number of ring segments 12 could be used.

Figure 3:
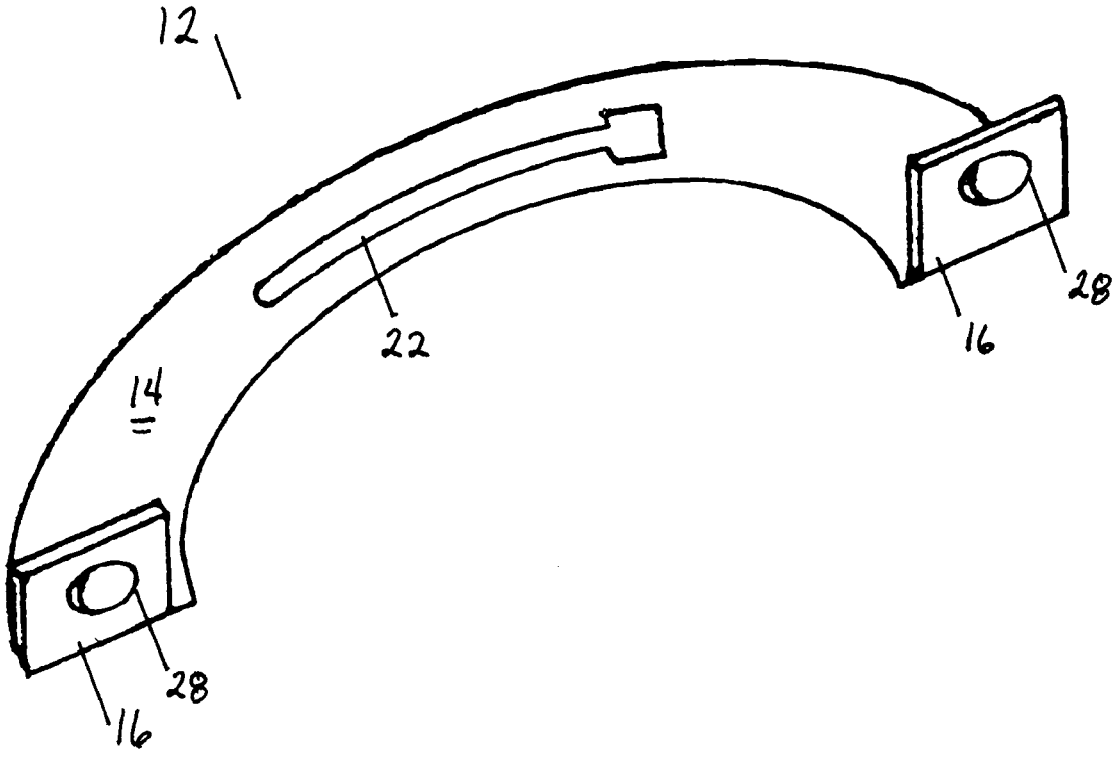
FIG. 3 shows an elevated perspective view of a ring segment according to the embodiment of FIG. 1.
Figure 4:
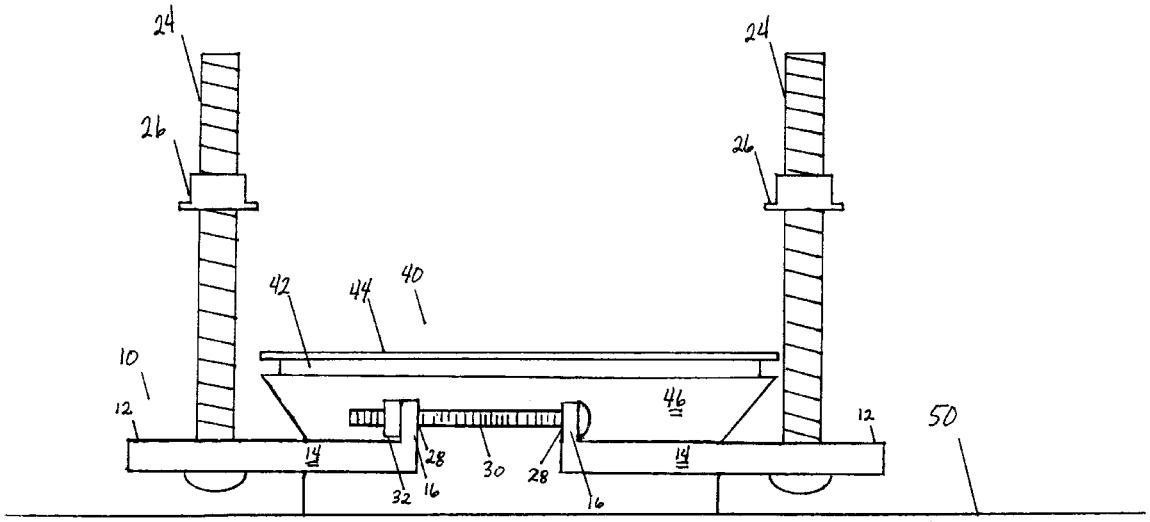
FIG. 4 shows a side view of the ring according to the embodiment of FIG. 1 assembled around a sewer pipe.

Each ring segment 12 includes a flat collar portion 14 and two end portions 16. At least one of the end portions 16 is upwardly projecting; that is, the end portion 16 extends perpendicular to the flat collar portion 14. In the embodiment of FIGS. 1 and 3, both end portions 16 of both ring segments 12 project upward from the collar portion 14. In the embodiment shown in FIG. 2, two of the adjacent ends 18 are shaped to overlap to form a hinge 20; the opposite ends extend upward from the collar portion 14. In both embodiments, slots 22 are disposed on the collar portion 14 of the ring segment 12. With reference to FIG. 4, once the ring 10 is assembled around the sewer pipe 40 as described below, the toilet is secured to the ring 10, and, consequently, the sewer pipe 40, by passing bolts 24 through the slots 22 and through holes in the base of the toilet and securing the bolts 24 with nuts 26.

Referring to FIG. 3, it can be seen that the upward extending end portions 16 include holes 28 which are aligned when the ring segments 12 are arranged adjacent to one another. In the embodiment shown in FIG. 1, a fastener, such as a bolt 30, is threaded into a nut 32 or a tapped hole 28 assemble the ring segments 12 into a substantially circular ring 10. While a bolt 30 is used in FIG. 1, it is contemplated, however, that any fastener, such as a pin, brad, rivet, or the like, could be used. The bolts 30 also provide a means for adjusting the diameter of the ring 10. That is, the bolt 30 may be threaded in a forward direction to draw the segments 12 inward or a reverse direction to allow the segments 12 to separate.

In FIG. 2, the overlapping end portions 18 are hinged with a pin, brad, rivet, or the like. Thus, as the adjusting means is operated, the ring segments 12 pivotally draw together or separate.

With reference to FIG. 4, a typical plumbing system includes an outwardly flared sewer pipe 40. The sewer pipe 40 typically includes a channel 42 around its upper edge in which the old toilet ring is retained. The old toilet ring is usually a continuous ring which is secured to both the floor 50 and the toilet. Typically a gasket (not shown), such as a wax gasket, is disposed between the sewer pipe 40 and the toilet drain to fluidly seal the connection.

To replace the old toilet ring, the toilet is first disconnected from the ring. This usually requires the removal of two bolts 24 on the sides of the toilet. The toilet is disconnected from the toilet flange 44 at the end of the flared sewer pipe 40. The ring is then disengaged from the floor 50 by removing a plurality of screws holding the ring to the floor 50. The ring is then removed from the sewer pipe 40. Depending on the condition of the ring, the ring may be cut or broken away from the channel 42.

The sewer pipe 40 is then ready to receive the replacement ring 10 of the present invention. The ring segments 12 are arranged around the sewer pipe 40 below the flare 46. The ring segments 12 are assembled by passing the bolts 30 through the upwardly extending end portions 16. The diameter of the assembled ring 10 is adjusted to clamp around the flare 46 of the sewer pipe 40. As can be appreciated, because the diameter of the assembled ring 10 is adjustable, the replacement ring 10 need not be disposed in the channel 42. Rather, the outward flare 46 of the sewer pipe 40 engages the replacement ring 10 and prevents it from moving from the sewer pipe 40. The gasket (not shown) is replaced and the toilet is secured in fluid communication with the sewer pipe 40 by securing the toilet to the replacement ring 10 by passing bolts 24 through the slots 22.

It is an advantage of the present invention that the replacement toilet ring 10 is segmented or hinged and, thus, may be assembled around a flared sewer pipe 40 without removing or otherwise destroying the flare 46. It is another advantage of the present invention that the replacement toilet ring 10 need not be secured to the floor 50 because it is secured below the flare 46 of the sewer pipe 40. Thus, the number of holes in the toilet ring 10 is reduced or eliminated altogether, thereby reducing or eliminating the locations where corrosion and weakening may occur. Yet another advantage of the invention is that the replacement ring 10 of the present invention is adjustable to accommodate different diameter sewer pipes 40. A further advantage of the invention is that the replacement ring 10 can be adjusted to clamp below the flare 46 of the sewer pipe 40. Thus, the replacement ring 10 can be used to secure a toilet to a sewer pipe 40 without using the channel 42 disposed around the sewer pipe 40.

I claim:

1. A ring for securing a toilet in fluid communication with the flange of a sewer pipe, comprising:

a plurality of ring segments, each ring segment having a flat collar portion defining a flat upper surface and provided with a slot and at least one end portion projecting perpendicularly and upwardly from said upper surface, said ring segments adapted to be adjustably assembled about the sewer pipe with said end portions in alignment;

a removable fastener coupled between the aligned end portions to close the ring segments about the pipe and adjust the diameter of the ring; and means for securing said toilet to said ring through said slot.

2. The ring of claim 1 further comprising a hinge connecting adjacent end portions of adjacent ring segments.

3. The ring of claim 1 wherein adjacent end portions of adjacent ring segments include holes therethrough and said fastener is disposed through said holes.

4. A ring for securing a toilet in fluid communication with the flange of an outwardly flared sewer pipe comprising:

a first ring segment having a substantially semicircular flat collar portion defining a flat upper surface and provided with a slot therethrough and two end portions projecting perpendicularly and upwardly from said upper surface;

a second ring segment having a substantially semicircular flat collar portion defining a flat upper surface and provided with a slot therethrough and two end portions projecting perpendicularly and upwardly from said upper surface, said first and second ring segments adapted to be adjustably assembled about the sewer pipe with said end portions in alignment;

a removable fastener coupled between the aligned end portions to close the ring segments below the flare of the sewer pipe and adjust the diameter of the ring; and means for securing the toilet to said ring through said slots.

5. The ring of claim 4 wherein said end portions have holes therethrough and said fastener is disposed through said holes.

6. A method of replacing a toilet ring with a replacement toilet ring, wherein said toilet ring secures a toilet to the floor in communication with a flared sewer pipe, comprising:

disconnecting the toilet from the toilet ring;

disconnecting the toilet from the toilet flange at the end of the flared sewer pipe;

disengaging the toilet ring from the floor;

removing the toilet ring from around the sewer pipe while leaving the flared sewer pipe intact;

providing a replacement toilet ring comprising:

a first ring segment having a substantially semicircular flat collar portion defining a flat upper surface and provided with a slot therethrough and two end portions projecting perpendicularly and upwardly from said upper surface;

a second ring segment having a substantially semicircular flat collar portion defining a flat upper surface and provided with a slot therethrough and two end portions projecting perpendicularly and upwardly from said upper surface, said first and second ring segments adapted to be adjustably assembled about the sewer pipe with said end portions in alignment;

a removable fastener coupled between the aligned end portions to close the ring segments below the flare of the sewer pipe and adjust the diameter of the ring; and means for securing the toilet to said ring through said slots;

arranging said ring segments around the sewer pipe below the flare with said end portions in alignment;

assembling said ring segments to form a substantially circular replacement ring about the sewer pipe;

adjusting the diameter of said circular ring to clamp around the flare of said sewer pipe;

positioning the toilet over said replacement ring with the toilet in fluid communication with said sewer pipe; and securing the toilet to the ring through said slots.

7. The method of claim 6 wherein said end portions of said first and second segments have holes therethrough and said fastener is disposed through said holes.

* * * * *